US008525080B2

(12) United States Patent
Ruther

(10) Patent No.: US 8,525,080 B2
(45) Date of Patent: Sep. 3, 2013

(54) OVEN, ESPECIALLY DOMESTIC OVEN AND METHOD FOR OPERATING SUCH AN OVEN

(75) Inventor: Florian Ruther, Rothenburg ob der Tauber (DE)

(73) Assignee: Electrolux Home Products Corporation N.V., Zaventem (BE)

( * ) Notice: Subject to any disclaimer, the term of this patent is extended or adjusted under 35 U.S.C. 154(b) by 0 days.

(21) Appl. No.: 12/445,492

(22) PCT Filed: Oct. 30, 2007

(86) PCT No.: PCT/EP2007/009411

§ 371 (c)(1),
(2), (4) Date: Apr. 14, 2009

(87) PCT Pub. No.: WO2008/052745

PCT Pub. Date: May 8, 2008

(65) Prior Publication Data

US 2010/0025390 A1 Feb. 4, 2010

(30) Foreign Application Priority Data

Nov. 2, 2006 (EP) ..... 06022797

(51) Int. Cl.
*A21B 1/02* (2006.01)
*A21B 1/26* (2006.01)
*F24C 7/06* (2006.01)

(52) U.S. Cl.
USPC ..... 219/400; 126/21 A; 99/474

(58) Field of Classification Search
None
See application file for complete search history.

(56) References Cited

U.S. PATENT DOCUMENTS

| | | | | |
|---|---|---|---|---|
| 3,887,716 | A * | 6/1975 | Seelbach | 426/231 |
| 4,051,347 | A | 9/1977 | Rohrl et al. | |
| 4,381,442 | A | 4/1983 | Guibert | |
| 4,426,923 | A * | 1/1984 | Ohata | 99/468 |
| 4,549,072 | A * | 10/1985 | Brist et al. | 219/400 |
| 5,451,744 | A * | 9/1995 | Koopman et al. | 219/400 |
| 6,376,817 | B1 * | 4/2002 | McFadden et al. | 219/681 |
| 7,308,852 | B2 * | 12/2007 | Kaminaka et al. | 99/476 |
| 7,642,488 | B2 * | 1/2010 | Kim et al. | 219/400 |
| 7,759,615 | B2 * | 7/2010 | Ando et al. | 219/401 |
| 8,049,142 | B2 * | 11/2011 | Blackson et al. | 219/398 |
| 2003/0047553 | A1 * | 3/2003 | Patti et al. | 219/400 |

(Continued)

FOREIGN PATENT DOCUMENTS

| | | |
|---|---|---|
| DE | 2646034 A1 | 4/1978 |
| DE | 2757059 A1 | 6/1979 |

(Continued)

OTHER PUBLICATIONS

International Search Report for PCT/EP2007/009411, dated Feb. 22, 2008, 3 pages.

(Continued)

*Primary Examiner* — Joseph M Pelham
(74) *Attorney, Agent, or Firm* — Pearne & Gordon LLP

(57) ABSTRACT

The invention relates to an oven (1), especially to a domestic oven, with a cooking cavity (2), wherein means (3, 4, 5, 6) are arranged for supplying hot air to the cavity (2). To improve the cooking result the invention is characterized in that the means (3, 4, 5, 6) comprise at least two heating elements (3, 4), wherein air is ventilated along or through the heating elements (3, 4) by at least one fan (5, 6). Furthermore, the invention relates to a method for operating such an oven.

11 Claims, 2 Drawing Sheets

(56) References Cited

U.S. PATENT DOCUMENTS

Figure 2:
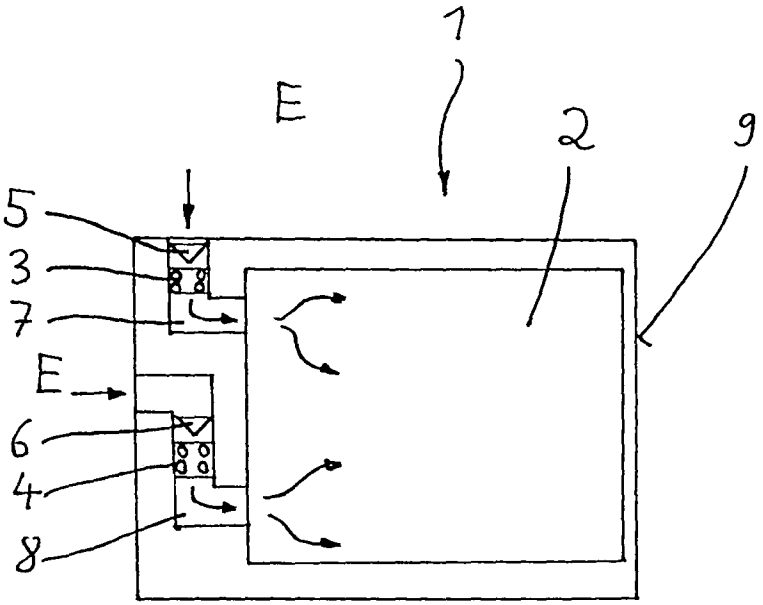

| | | | | |
|---|---|---|---|---|
| 2003/0116555 | A1* | 6/2003 | Wakefield et al. | 219/400 |
| 2004/0040950 | A1 | 3/2004 | Carbone et al. | |
| 2004/0129692 | A1* | 7/2004 | Kim et al. | 219/400 |
| 2005/0005781 | A1* | 1/2005 | Ohtsuka et al. | 99/476 |
| 2006/0027559 | A1* | 2/2006 | Kim et al. | 219/400 |
| 2006/0137675 | A1* | 6/2006 | Kim et al. | 126/21 A |
| 2006/0186108 | A1* | 8/2006 | Kim et al. | 219/400 |
| 2006/0289436 | A1* | 12/2006 | Carbone et al. | 219/400 |
| 2007/0095813 | A1* | 5/2007 | Sung et al. | 219/400 |

FOREIGN PATENT DOCUMENTS

| | | | |
|---|---|---|---|
| DE | 202004015290 | U1 | 2/2006 |
| EP | 0596263 | A | 5/1994 |
| EP | 1674798 | A | 6/2006 |
| FR | 2213461 | A | 8/1974 |

OTHER PUBLICATIONS

Canadian Office Action mailed Mar. 25, 2011, 2 pages.

* cited by examiner

OVEN, ESPECIALLY DOMESTIC OVEN AND METHOD FOR OPERATING SUCH AN OVEN

The invention relates to an oven, especially to a domestic oven, with a cooking cavity, wherein means are arranged for supplying hot air to the cavity. Furthermore, the invention relates to a method for operating such an oven.

Ovens of this kind are well known in the art and useful for an effective cooking using hot air. Pre-known hot air systems for domestic ovens work normally with a heating element and a fan wheel that blows air from the environment onto the heating element to heat the air and heat with the hot air the food in the oven.

Some recipes that have a high mass and water content require a high heat transfer to the food especially in the beginning of the cooking or baking process in order to e.g. seal the surface of the food or to dry out the surface of the food fast enough.

Other recipes need a lower heat transfer to prevent the burning of the food. A generally higher heating power leads also to a higher energy consumption because not every kind of food can absorb the same heat quantity.

Pre-known hot air ovens have deficiencies to adapt the cooking parameters in an optimized way when hot air is applied for the cooking process.

Therefore, it is an object of the invention to provide an oven, especially a domestic oven, which uses hot air for cooking purposes and which is able to better optimize the supply of hot air to the food in the cooking cavity. It should become possible to run a cooking process in the oven with optimized parameters with respect to the supply of heated air into the cavity.

Furthermore, a method for operating such an oven is to be proposed which achieves better cooking results.

The solution of this object according to the invention relating to an oven is characterized in that the means for supplying hot air to the cavity comprise at least two heating elements, wherein air is ventilated along or through the heating elements by at least one fan.

Preferably, the at least two heating elements are arranged along one common flow path which leads to the cavity. It is also possible, that the at least two heating elements are arranged along at least two flow paths which lead to the cavity. In the latter case each heating element can have its own flow path, which leads to the cavity. By this arrangement it is possible that one of the flow paths discharges in an upper region of the cavity to heat up specifically that region of it. Furthermore, it becomes possible that one of the flow paths discharges in a lower region of the cavity to specifically load heat in that region of it.

According to one embodiment of the invention all heating elements have the same heating power. A typical value for the power is 1.500 W. It is also possible that at least two heating elements have different heating powers. Normally, the power of such a heating element is between 1.000 W and 2.000 W.

A preferred embodiment is characterized in that a circular heating element is arranged around the fan.

A cheap realization of the invention is possible when the heating elements are designed to have a switch on position and a switch off position only.

To deal with the different recipes according to the invention an oven can be equipped with a hot air system with (at least) two heating elements which can be switched on an off and can be combined to have the optimal power adapted to the recipe.

The method for operating an oven, especially a domestic oven, is characterized in that air is ventilated through at least one flow path which leads to the cavity, wherein the air is heated up during its passage of the at least one flow path by means of at least two heating elements and wherein air is ventilated along or through the at least two heating elements by at least one fan.

Preferably, the air is heated up by passing the at least two heating elements, which are arranged along one common flow path which leads to the cavity. Alternatively, the air is heated up by passing the at least two heating elements, which are arranged along two separate flow paths which lead to the cavity.

The hot air can preferably be discharged in an upper or in a lower region of the cavity.

With the suggested equipment and method according to the invention a hot air system is supplied by which different heating powers can be realized depending on the requirements of the recipe.

In principle the adaptation of the heating power could also be realized with only one heating element, which could e.g. have a heating power of 3.000 W and which is switched on and off in certain intervals. But by this way a larger variation of the oven temperature is created in a kind like a saw-tooth-profile. This would lead to a more uneven heat distribution and to a worse cooking or baking performance.

By the proposal according to the invention a better uniformity of the heating situation is achieved. The more heating elements are used the more even the temperature profile gets. Accordingly, the more even the browning of the food gets.

The adjustable heating power can be used to create special heating modes for the oven, for example one for heavy loads, one for fast cooking or baking and one for very slow heating up.

Depending on the position of the heating elements relative to the direction of the air flow a higher heat transfer can be forced in a certain area only by using the hot air system.

Consequently, the overlapping of heating power of at least two heating elements can be effective to adjust the average heating power.

In the drawings embodiments of the invention are depicted.

Figure 1:
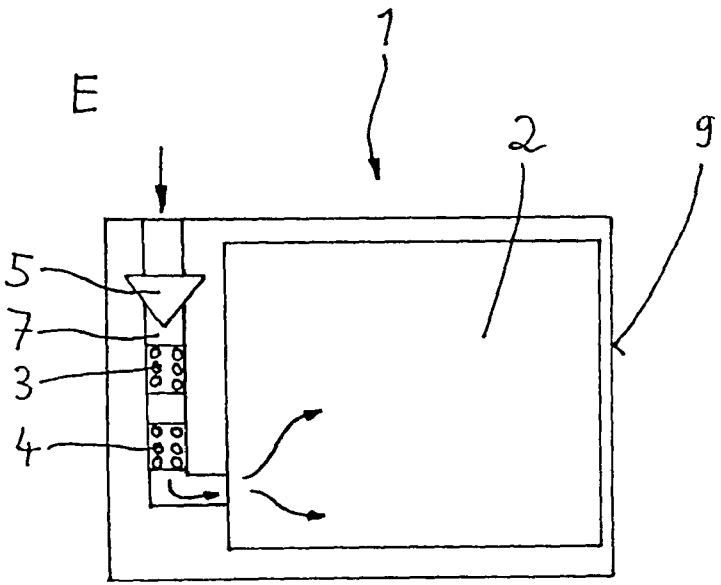
Figure 4:
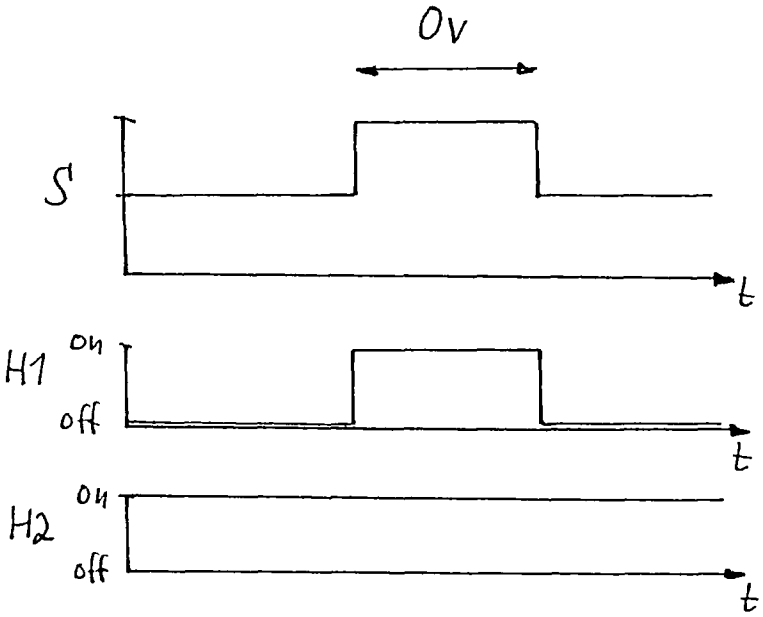
Figure 3:
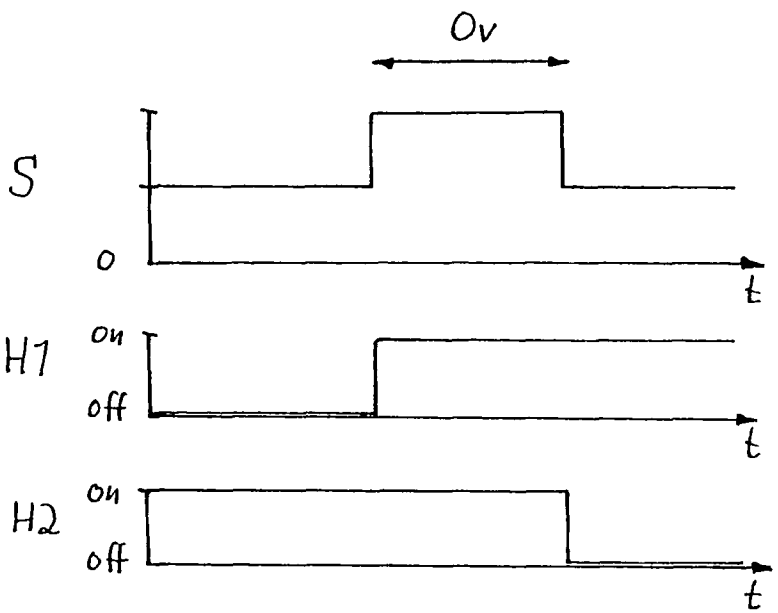

FIG. 1 shows schematically a first embodiment of a domestic oven from the side, FIG. 2 shows a second embodiment of the invention in the illustration according to FIG. 1, FIG. 3 shows the switching situation over the time of two heating elements of the oven according to a first method of operation and FIG. 4 shows an alternative switching situation in the depiction of FIG. 3.

FIG. 1 shows a first embodiment of a domestic oven 1. It has a cooking cavity 2 which can be opened by a door 9 to put food into the cavity 2 and to take cooked food out of it. The oven 1 is equipped with means 3, 4, 5, 6 for supplying hot air into the cavity 2 for cooking or baking the food in the cavity 2.

This means according the embodiment of FIG. 1 comprise two heating elements 3 and 4 which are inserted into a flow path 7 which connects the environment E with the cavity 2.

It should be mentioned that also a circuit air flow can take place from the cavity 2 in the flow path 7 and back to the cavity 2.

The air is ventilated by a fan 5. The air heated by the heating elements 3 and 4 is loaded into the cavity 2 in a bottom region of it.

In the embodiment according FIG. 2 there are arranged two separate hot air supplies: Hot air is loaded into the cavity 2 in an upper region of the cavity 2 by means of a first heating element 3 which is arranged in a first flow path 7, in which also a first fan 5 is integrated. Furthermore, additional hot air is loaded into a lower region of the cavity 2 by means of a second heating element 4 which is arranged in a second flow path 8, in which a second fan 6 is integrated.

By controlling the switching of the heating elements 3, 4 and the fans 5, 6 respectively the input of heating power into the cavity 2 can be effectively regulated. A not depicted control unit switches the heating element and fans respectively as illustrated in two examples in FIGS. 3 and 4.

In FIG. 3 a principle of switching the heating elements is shown. The figure shows a heating cycle which can be defined as a certain time interval.

FIG. 3 shows the switching situation of a first heating element H1 (e.g. the heating element 3 in FIGS. 1 and 2) and a second heating element H2 (e.g. the heating element 4 in FIGS. 1 and 2). The heating elements H1 and H2 can be switches on or off only. The respective switching position is depicted over the time t during the cooking process.

It can be seen that a certain overlapping phase Ov takes place when both heating elements H1 and H2 are switched on. Reference is made to the sum S in the upper diagram.

In FIG. 4 an alternative switching situation is depicted. Here the heating element H2 is switched on continuously. For a certain time, the first heating element H1 is switched on additionally. So also here an overlapping phase Ov takes place in which the heating power into the cavity is specifically high.

The power can be adapted by adjusting the length of the overlapping interval Ov shown in FIGS. 3 and 4, i.e. the phase in which both heating elements H1, H2 are switched on.

By the described method, the minimum power per cycle is the power of one heating element. In the embodiment each heating element has a heating power of 1.500 W, which is the minimum heating power. The maximum power is that of both heating elements, i.e. 3.000 W.

The maximal and minimal power possible can be adjusted by the powers of the heating elements H1, H2 which are equal in the embodiments. It is also possible that the heating powers of the two (or more) heating elements are not equal. I.e. the heating power of the heating elements must not necessarily be equal.

To use more heating elements it must be ensured that the same amount of air is flowing past each element, otherwise the heat distribution gets uneven in the cavity, too. This problem can be solved for example by having two circular heating elements around one fan.

But also a geometry where the heater sit in different positions regarding the air flow is possible for example to achieve a higher heat transfer in a certain area of the oven cavity. There could be for example two fan wheels with a heating element around each that are placed one in the upper part and one in the lower part of the cavity (see FIG. 2).

With a heater switching as shown in FIG. 4 a higher heat transfer can be obtained in one half of the cavity.

REFERENCE NUMERALS

1 Oven (domestic oven)
2 Cooking cavity
3, 4
5, 6 Means for supplying hot air
3 Heating element
4 Heating element
5 Fan
6 Fan
7 Flow path
8 Flow path
9 Door
E Environment
Ov Overlapping phase
S Sum of heating powers
H1 Heating element 1
H2 Heating element 2
t Time

The invention claimed is:

1. Oven comprising a cooking cavity, wherein means are arranged for supplying hot air to the cavity from the environment, wherein the means comprise at least a first and a second heating element, wherein air is ventilated through the first and second heating elements by at least one fan and prior to entering the cooking cavity, further wherein the first and second heating elements are arranged along one common flow path which leads to the cavity so that the second heating element is arranged downstream of the first heating element, wherein the first and second heating elements are designed to be independently operable, each having a switch on position and a switch off position only, and wherein each heating element has a heating power between 1,000 W to 2,000 W, wherein the flow path is vertically arranged parallel to a sidewall of the cooking cavity, the fan is positioned along the flow path near a top portion of the oven and the first and second heating elements are positioned downstream of the at least one fan at lower elevations than the at least one fan.

2. Oven according to claim 1, wherein all heating elements have the same heating power.

3. Oven according to claim 1, wherein at least two heating elements have different heating powers.

4. Oven according to claim 1, wherein all heating elements are electrical heating elements.

5. Oven according to claim 1, wherein substantially all of the air ventilated through the first and second heating elements is drawn from the environment exterior to the oven.

6. Method for operating an oven comprising, a cooking cavity and mechanism for supplying hot air to the cavity, wherein air is ventilated from the environment through one common flow path which leads to the cavity, wherein the air is heated up during its passage of the flow path by at least two heating elements prior to entering the cooking cavity and wherein air is ventilated through the at least two heating elements by at least one fan, and wherein each heating element is independently operable, each having a heating power between 1,000 W and 2,000 W, wherein the flow path is vertically arranged parallel to a sidewall of the cooking cavity, the fan is positioned near a top portion of the oven and the heating elements are positioned along the flow path downstream of the at least one fan at lower elevations than the at least one fan.

7. Method according to claim 6, wherein the hot air is discharged in an upper region of the cavity.

8. Method according to claim 6, wherein the hot air is discharged in a lower region of the cavity.

9. Method according to claim 6, wherein substantially all of the air ventilated through the at least two heating elements is drawn from the environment exterior to the oven.

10. Oven comprising:

a cooking cavity;

a first heating element positioned within a flow path, the flow path being in fluid communication with the cooking cavity, the flow path vertically arranged parallel to a sidewall of the cooking cavity;

a second heating element positioned within the flow path and downstream of the first heating element; and at least one fan configured to supply hot air to the cooking cavity, the fan positioned near a top portion of the oven, wherein the first heating element and the second heating element are independently operable and positioned along the flow path downstream of the at least one fan and at lower elevations than the at least one fan, wherein the hot air supplied to the cooking cavity is heated by the first and second heating elements prior to entering the cooking cavity, and wherein each heating element has a heating power between 1,000 W and 2,000 W.

11. Oven according to claim 10, wherein substantially all of the air supplied to the cavity is drawn from the environment exterior to the oven.

* * * * *